US009284498B2

(12) United States Patent
Kokayeff et al.

(10) Patent No.: US 9,284,498 B2
(45) Date of Patent: Mar. 15, 2016

(54) PROCESS FOR PRODUCING DIESEL

(71) Applicant: UOP LLC, Des Plaines, IL (US)

(72) Inventors: Peter Kokayeff, Naperville, IL (US); Paul R. Zimmerman, Palatine, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 14/597,809

(22) Filed: Jan. 15, 2015

(65) Prior Publication Data

US 2015/0119614 A1 Apr. 30, 2015

Related U.S. Application Data

(63) Continuation of application No. 13/687,757, filed on Nov. 28, 2012, now Pat. No. 8,936,714.

(51) Int. Cl.

| | |
|---|---|
| ***C10G 65/12*** | (2006.01) |
| ***C10G 67/02*** | (2006.01) |
| ***C10G 67/06*** | (2006.01) |
| ***C10L 1/08*** | (2006.01) |

(52) U.S. Cl.

CPC ..... *C10G 67/02* (2013.01); *C10G 65/12* (2013.01); *C10G 67/06* (2013.01); *C10L 1/08* (2013.01); *C10G 2400/04* (2013.01); *C10L 2200/0446* (2013.01); *C10L 2200/0469* (2013.01); *C10L 2270/026* (2013.01); *C10L 2290/541* (2013.01); *C10L 2290/543* (2013.01)

(58) Field of Classification Search

USPC ..... 208/49, 58–59, 88–89, 106–108, 280 R, 208/209–211

See application file for complete search history.

(56) References Cited

U.S. PATENT DOCUMENTS

| | | | | |
|---|---|---|---|---|
| 3,481,716 | A * | 12/1969 | Mrstik et al. | 44/366 |
| 5,871,618 | A * | 2/1999 | Lee et al. | 196/46.1 |
| 6,638,418 | B1 * | 10/2003 | Kalnes et al. | 208/89 |
| 2004/0238406 | A1 * | 12/2004 | Kanataev et al. | 208/108 |

* cited by examiner

*Primary Examiner* — Brian McCaig
(74) *Attorney, Agent, or Firm* — James C. Paschall

(57) ABSTRACT

A process is disclosed for hydrocracking a primary hydrocarbon feed and a diesel co-feed in a hydrocracking unit and hydrotreating a diesel product from the hydrocracking unit in a hydrotreating unit. The diesel stream fed through the hydrocracking unit is pretreated to reduce sulfur and ammonia and can be upgraded with noble metal catalyst.

20 Claims, 2 Drawing Sheets

PROCESS FOR PRODUCING DIESEL

CROSS-REFERENCE TO RELATED APPLICATION

This application is a Continuation of application Ser. No. 13/687,757 filed Nov. 28, 2012, now U.S. Pat. No. 8,936,714, the contents of which are hereby incorporated by reference in its entirety.

FIELD OF THE INVENTION

The field of the invention is the production of diesel by hydrocracking

BACKGROUND OF THE INVENTION

Hydrocracking refers to a process in which hydrocarbons crack in the presence of hydrogen and catalyst to lower molecular weight hydrocarbons. Depending on the desired output, the hydrocracking zone may contain one or more beds of the same or different catalyst. Hydrocracking is a process used to crack hydrocarbon feeds such as vacuum gas oil (VGO) to diesel including kerosene and gasoline motor fuels.

Mild hydrocracking is generally used upstream of a fluid catalytic cracking (FCC) or other process unit to improve the quality of an unconverted oil that can be fed to the downstream FCC unit, while converting part of the feed to lighter products such as diesel. As world demand for diesel motor fuel is growing relative to gasoline motor fuel, mild hydrocracking is being considered for biasing the product slate in favor of diesel at the expense of gasoline. Mild hydrocracking may be operated at a lower severity than partial or full conversion hydrocracking to balance production of diesel with the FCC unit, which primarily is used to make naphtha. Partial or full conversion hydrocracking is used to produce diesel with less yield of the unconverted oil which can be fed to a downstream unit.

Due to environmental concerns and newly enacted rules and regulations, saleable diesel must meet lower and lower limits on contaminants, such as sulfur and nitrogen. New regulations require essentially complete removal of sulfur from diesel. For example, the ultra low sulfur diesel (ULSD) requirement is typically less than about 10 wppm sulfur.

The cetane rating of diesel can be improved by saturating aromatic rings. Catalysts for saturating aromatic rings are typically noble metal catalysts. The cloud point and pour point of diesel can be improved by isomerizing paraffins to increase the degree of branched alkyl groups on the paraffins. Isomerization catalysts can also be noble metal catalyst. Noble metal catalysts are typically poisoned by sulfur species.

There is a continuing need, therefore, for improved methods of producing more diesel from hydrocarbon feedstocks than gasoline. Such methods must ensure that the diesel product meets increasingly stringent product requirements.

BRIEF SUMMARY OF THE INVENTION

In a process embodiment, the invention comprises a process for producing diesel from a hydrocarbon stream comprising feeding a primary hydrocarbon stream to a hydrocracking reactor. A co-feed hydrocarbon stream comprising diesel is also co-fed to the hydrocracking reactor. The primary hydrocarbon stream and the co-feed hydrocarbon stream are hydrotreated in the presence of the hydrocracking hydrogen stream and pretreating catalyst to provide a pretreated effluent stream. The pretreated effluent stream is hydrocracked in the presence of hydrocracking catalyst to provide a hydrocracking effluent stream. At least a portion of the hydrocracking effluent stream is fractionated to provide a diesel stream. Lastly, the diesel stream is hydrotreated in the presence of a hydrotreating hydrogen stream and hydrotreating catalyst to provide a hydrotreating effluent stream.

In an additional process embodiment, the invention further comprises a process for producing diesel from a hydrocarbon stream comprising feeding a primary hydrocarbon stream to a hydrocracking reactor. A co-feed hydrocarbon stream having an initial boiling point between about 121° C. (250° F.) and about 288° C. (550° F.) is also co-fed to said hydrocracking reactor. The primary hydrocarbon stream and the co-feed hydrocarbon stream are hydrotreated in the presence of the hydrocracking hydrogen stream and pretreating catalyst to provide a pretreated effluent stream. The pretreated effluent stream is hydrocracked in the presence of hydrocracking catalyst and the hydrocracking hydrogen stream remaining in the pretreated effluent stream to provide a hydrocracking effluent stream. At least a portion of the hydrocracking effluent stream is fractionated to provide a diesel stream having an initial boiling point between about 121° C. (250° F.) and about 288° C. (550° F.). Lastly, the diesel stream is hydrotreated in the presence of a hydrotreating hydrogen stream and hydrotreating catalyst to provide a hydrotreating effluent stream.

In a further embodiment, the primary hydrocarbon stream has an initial boiling point of no less than about 150° C. (302° F.) and an end point of no more than about (621° C.). 1150° F.

Feeding hydrogen gas to the hydrotreating unit at equivalent pressure as the hydrocracking unit and adding any diesel co-feeds to the pretreat hydrotreating reactor of the hydrocracking unit instead of to the distillate hydrotreating unit allows the pretreat hydrotreating unit to operate as a hydrotreater to produce ULSD. Additionally, the distillate hydrotreating unit can be charged with a noble metal aromatics saturation catalyst or isomerization catalyst to upgrade cetane rating or cloud point in the resulting diesel product because much of the sulfur is removed in the pretreat hydrotreating reactor of the hydrocracking unit.

DEFINITIONS

Figure 1:
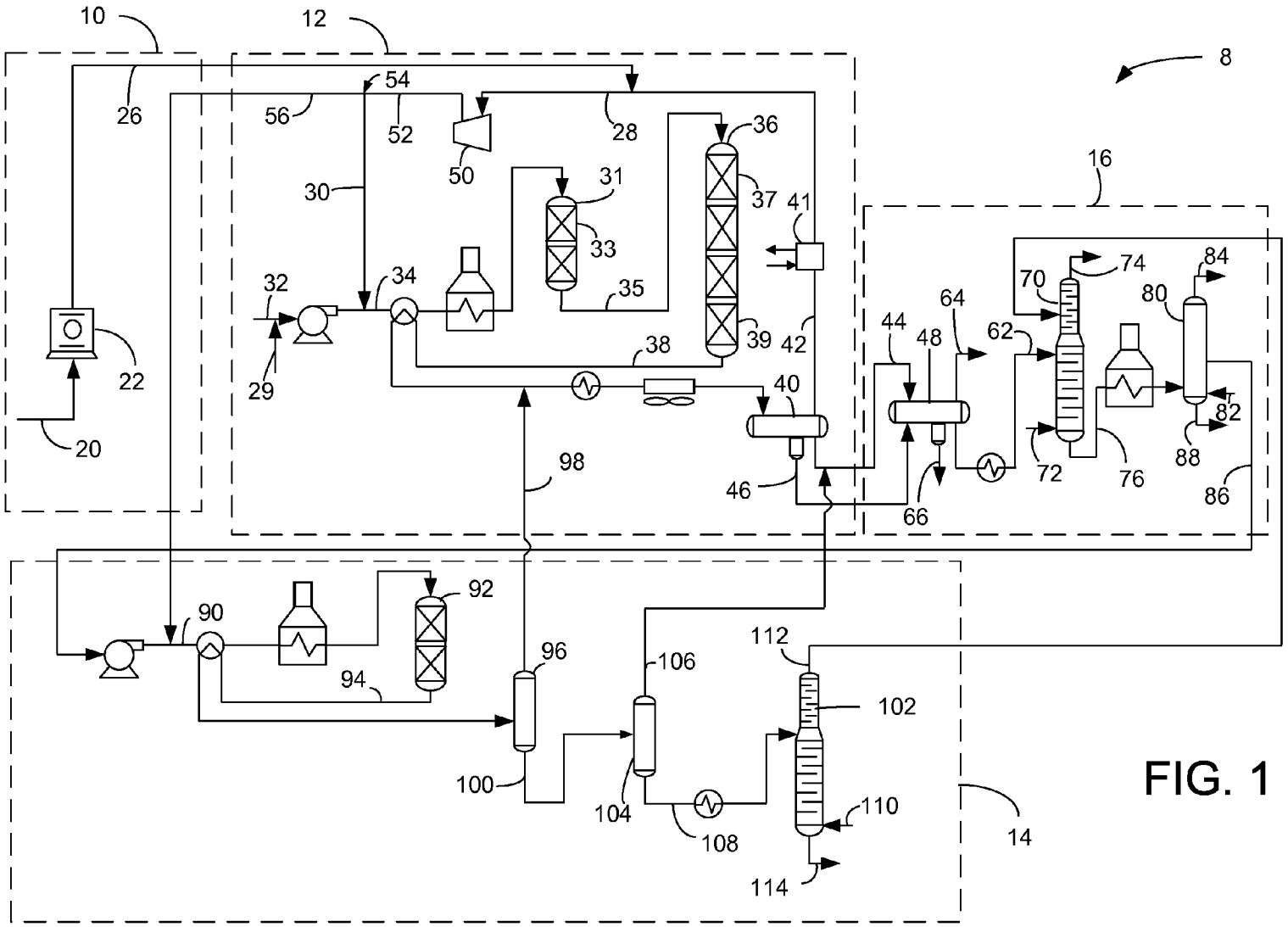
FIG. 1 is a simplified process flow diagram of an embodiment of the present invention.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of the reflux or reboil to the column.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "conversion" means conversion of feed to material that boils at or below the diesel boiling range. The cut point of the diesel boiling range is between about 343° and about 399° C. (650° to 750° F.) using the True Boiling Point distillation method.

As used herein, the term "diesel boiling range" means hydrocarbons boiling in the range of between about 132° and about 399° C. (270° to 750° F.) using the True Boiling Point distillation method.

As used herein, the terms "distillate" and "diesel" can be used interchangeably.

DETAILED DESCRIPTION

Mild hydrocracking reactors operate at low severity and therefore low conversion. The diesel produced from mild hydrocracking is not of sufficient quality to meet applicable fuel specifications particularly with regard to sulfur. As a result, the diesel produced from mild hydrocracking must be processed in a distillate hydrotreating unit to allow blending into finished diesel. In many cases, it is attractive to integrate the mild hydrocracking unit and the distillate hydrotreating unit to reduce capital and operating costs.

Feeding an external co-feed diesel stream to a distillate hydrotreating reactor along with distillate produced in the hydrocracking unit may bring a high level of sulfur into the distillate hydrotreating reactor. As a result, noble metal catalyst cannot be used in the distillate hydrotreating reactor because the high level of sulfur in the co-feed would render the noble metal ineffective. The only recourse would be to route the diesel processed in the distillate hydrotreating unit to a new stripper and route the stripper bottoms to a new reactor charged with noble metal catalyst for cetane improvement. In our invention, the diesel co-feed stream is pretreated with a hydrotreating catalyst in a bed or reactor of the hydrocracking unit instead of being routed to the distillate hydrotreating unit. The distillate hydrotreating unit processes only the distillate from the fractionation section (which now includes the hydrotreated co-feed). The sulfur concentration in the total hydrocracked distillate would be in the range of 20 to 200 wppm, rendering the distillate suitable for processing in an aromatics saturation or isomerization reactor charged with noble metal catalyst for production of high cetane and/or low pour point diesel. The distillate hydrotreating reactor may be charged with hydrotreating catalyst to produce low sulfur diesel. When desired, the distillate hydrotreating reactor may be easily converted to an aromatics saturation reactor to produce high cetane and/or low pour point diesel by a simple catalyst change-out to or addition of a noble metal catalyst.

Turning to FIG. 1, the process 8 for producing diesel comprises a compression section 10, a hydrocracking unit 12, a hydrotreating unit 14 and a fractionation zone 16. Hydrocarbon feed is first fed to the hydrocracking unit 12 and converted to lower boiling hydrocarbons including diesel. The diesel is fractionated in a fractionation section therein and forwarded to the hydrotreating unit 14 to produce lower sulfur diesel.

A make-up hydrogen stream in a make-up hydrogen line 20 is fed to a train of one or more compressors 22 in the compression section 10 to boost the pressure of the make-up hydrogen stream and provide a compressed make-up stream in line 26. The compressed make-up stream in compressed make-up hydrogen line 26 may join with a vaporous hydrocracking effluent stream comprising hydrogen in an overhead line 42 to provide an introductory hydrogen stream in line 28. The compressed make-up hydrogen stream may be added to the vaporous hydrocracking effluent stream upstream of a recycle gas compressor 50 at a location such that, relative to the compressed make-up hydrogen line 26, the recycle gas compressor 50 is upstream of any hydroprocessing reactor, such as a hydrocracking reactor 36, pretreating reactor 31 or a distillate hydrotreating reactor 92. Consequently, in an aspect, no hydroprocessing reactor is located intermediate of the compressed make-up hydrogen line 26 and the recycle gas compressor 50.

The introductory hydrogen stream in line 28 comprising the compressed make-up hydrogen stream and the vaporous hydrocracking effluent stream may be compressed in a recycle gas compressor 50 to provide a compressed hydrogen stream in a compressed hydrogen line 52 which includes compressed vaporous hydrocracking effluent. The recycle gas compressor 50 may be in downstream communication with the hydrocracking reactor 36, the make-up hydrogen line 20 and the one or more compressors 22.

In an embodiment, the compressed make-up hydrogen stream may be added to the compressed hydrogen line 52 downstream of the recycle gas compressor 50. However, the pressure of the compressed hydrogen stream in line 52 may be too great to admit the make-up hydrogen stream without adding more compressors on the make-up hydrogen line 20. Consequently, adding the compressed make-up hydrogen stream to the vaporous hydrocracking effluent stream in line 42 upstream of the recycle gas compressor 50 may be advantageous, despite the increased duty on the recycle gas compressor 50 due to greater throughput. Adding the compressed make-up hydrogen stream upstream of the recycle gas compressor 50, however, may diminish the need for an additional compressor 22 on the make-up hydrogen line 20.

The compressed hydrogen stream in line 52 may be split between two hydrogen streams at a split 54. A first hydrocracking hydrogen stream may be taken from the compressed hydrogen stream in the compressed hydrogen line 52 at the split 54 in a first hydrogen split line 30. A second hydrotreating hydrogen stream may be taken from the compressed hydrogen stream in the compressed hydrogen line 52 at the split 54 in a second hydrogen split line 56. The first hydrogen split line 30 may be in upstream communication with the hydrocracking reactor 36 and the pretreating reactor 31, and the second hydrotreating hydrogen stream in a second hydrogen split line 56 may be in upstream communication with the distillate hydrotreating reactor 92.

The hydrocracking hydrogen stream in the first hydrogen split line 30 taken from the compressed hydrogen stream in line 52 may join a hydrocarbon feed stream in line 32 to provide a hydrocracking feed stream in line 34.

The primary hydrocarbon feed stream is introduced in primary hydrocarbon feed line 32 perhaps through a surge tank. In one aspect, the process described herein is particularly useful for hydroprocessing a hydrocarbonaceous feedstock. Applicable hydrocarbon feedstocks include hydrocarbonaceous streams having components having an initial boiling point suitably no less than about 150° C. (302° F.) and preferably no less than about 288° C. (550° F.), such as atmospheric gas oils, VGO, deasphalted, vacuum, and atmospheric residua, coker distillates, straight run distillates, solvent-deasphalted oils, pyrolysis-derived oils, high boiling synthetic oils, cycle oils, hydrocracked feeds, cat cracker distillates and the like. Suitable feeds may have an end point of no more than about (621° C.) 1150° F. These hydrocarbonaceous feed stocks may contain from about 0.1 to about 4 wt % sulfur and 300 to 1800 wppm nitrogen. A suitable hydrocarbonaceous feedstock is a VGO or other hydrocarbon fraction having at least about 50 percent by weight, and usually at least about 75 percent by weight, of its components boiling at a temperature above about 399° C. (750° F.). A typical VGO normally has a boiling point range between about 315° C. (600° F.) and about 621° C. (1150° F.).

An aspect of the invention is the provision of a separate hydrocarbon co-feed stream in addition to the primary hydrocarbon feed stream to the hydrocracking unit 12. The co-feed stream may be admixed with the primary hydrocarbon feed line 32 through a co-feed line 29.

The co-feed stream may be a diesel stream. The hydrocarbon co-feed stream preferably has an initial boiling point between about 121° C. (250° F.) and about 288° C. (550° F.) and an end point of no more than about 399° C. (750° F.).

Hydrocracking refers to a process in which hydrocarbons crack in the presence of hydrogen to lower molecular weight hydrocarbons. A hydrocracking reactor 36 is in downstream communication with the one or more compressors 22 on the make-up hydrogen line 20, the co-feed line 29 and the hydrocarbon feed line 32. The hydrocracking feed stream in line 34 comprising the mixed primary hydrocarbon feed stream and the hydrocarbon co-feed stream may be heat exchanged with a hydrocracking effluent stream in line 38 and further heated in a fired heater before entering the hydrocracking reactor 36 for hydrocracking the hydrocarbon stream to lower boiling hydrocarbons.

In an aspect of the present invention, the hydrocracking reactor 36 is preceded by a pretreating hydrotreating reactor 31 to remove nitrogen and sulfur species in the hydrocarbon feed stream. The preheated, primary hydrocarbon feed stream and the hydrocarbon co-feed stream in line 34 are hydrotreated in the presence of the hydrocracking hydrogen stream and pretreating hydrotreating catalyst in one or more catalyst beds 33 to provide a pretreated effluent stream in pretreat effluent line 35. In an aspect, the pretreating hydrotreating reactor may be a pretreat hydrotreating catalyst bed 37 in the hydrocracking reactor 36. The pretreat effluent comprising hydrotreated primary hydrocarbon and co-feed products and unconsumed hydrogen from the hydrocracking hydrogen stream preferably are transferred in line 35 to the hydrocracking reactor 36 without any separation or heating. Hydrogen streams may be injected between or after catalyst beds 33 to provide hydrogen requirements and/or to cool catalyst bed effluent.

The hydrocracking reactor 36 may comprise one or more vessels, multiple beds of catalyst in each vessel, and various combinations of hydrotreating catalyst and hydrocracking catalyst in one or more vessels. In some aspects, the hydrocracking reaction provides total conversion of at least about 20 vol % and typically greater than about 60 vol % of the hydrocarbon feed to products boiling below the diesel cut point. The hydrocracking reactor 36 may operate at partial conversion of more than about 50 vol % or full conversion of at least about 90 vol % of the feed based on total conversion. To maximize diesel, full conversion is effective. The first vessel or catalyst bed 37 may include pretreat hydrotreating catalyst for the purpose of pretreat hydrotreating of the primary hydrocarbon stream and the co-feed hydrocarbon stream when no separate pretreat hydrotreating reactor 31 is used or further demetallizing, desulfurizing or denitrogenating the hydrocracking feed from the pretreat hydrotreating reactor 31 is desired when such is used.

The hydrocracking reactor 36 may be operated at mild hydrocracking conditions. Mild hydrocracking conditions will provide about 20 to about 60 vol %, preferably about 20 to about 50 vol %, total conversion of the hydrocarbon feed to product boiling below the diesel cut point. In mild hydrocracking, converted products are biased in favor of diesel. In a mild hydrocracking operation, the hydrotreating catalyst may have just as much or a greater conversion role than hydrocracking catalyst. Conversion across the hydrotreating catalyst may be a significant portion of the overall conversion. If the hydrocracking reactor 36 is intended for mild hydrocracking, it is contemplated that the mild hydrocracking reactor 36 may be loaded with all hydrotreating catalyst, all hydrocracking catalyst, or some beds of hydrotreating catalyst and beds of hydrocracking catalyst. In the last case, the beds of hydrocracking catalyst may typically follow beds of hydrotreating catalyst. Most typically, from zero to three beds of hydrotreating catalyst may be followed by zero, one or two beds of hydrocracking catalyst.

The hydrocracking reactor 36 in FIG. 1 may have four beds in one reactor vessel. If mild hydrocracking is desired, it is contemplated that the first three catalyst beds 37 comprise hydrotreating catalyst and the last catalyst bed 39 comprise hydrocracking catalyst. In such an embodiment, the pretreat hydrotreating reactor 31 may be omitted in favor of pretreat hydrotreating catalyst in the initial beds 37 of the hydrocracking reactor 36. If partial or full hydrocracking is preferred, more beds of hydrocracking catalyst may be used in the hydrocracking reactor 36 than if mild hydrocracking is desired. One or more of the subsequent beds 39 in reactor 36 may contain hydrocracking catalyst. Hydrogen streams may be injected between catalyst beds 37, 39 to provide hydrogen requirements and/or to cool catalyst bed effluent.

At mild hydrocracking conditions, the feed is selectively converted to heavy products such as diesel and kerosene with a low yield of lighter hydrocarbons such as naphtha and gas. Pressure is also moderate to limit the hydrogenation of the bottoms product to an optimal level for downstream processing. The pretreated effluent stream is hydrocracked in the presence of hydrocracking catalyst and the hydrocracking hydrogen stream remaining in the pretreated effluent stream to provide a hydrocracking effluent stream in hydrocracking effluent line 38.

In one aspect, for example, when a balance of middle distillate and gasoline is preferred in the converted product, mild hydrocracking may be performed in the hydrocracking reactor 36 with hydrocracking catalysts that utilize amorphous silica-alumina bases or low-level zeolite bases combined with one or more Group VIII or Group VIB metal hydrogenating components. In another aspect, when middle distillate is significantly preferred in the converted product over gasoline production, partial or full hydrocracking may be performed in the hydrocracking reactor 36 with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The naturally occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt %.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° to about 648° C. (about 700° to about 1200° F.) in order to activate the catalyst and decompose ammonium ions. Alternatively, the base component may first be pelleted, followed by the addition of the hydrogenating component and activation by calcining The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt %. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

By one approach, the hydrocracking conditions may include a temperature from about 290° C. (550° F.) to about 468° C. (875° F.), preferably 343° C. (650° F.) to about 435° C. (815° F.), a pressure from about 3.5 MPa (500 psig) to about 20.7 MPa (3000 psig), a liquid hourly space velocity (LHSV) from about 0.5 to less than about 5.0 $hr^{-1}$ and a hydrogen rate of about 421 $Nm^3/m^3$ oil (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 5.0 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

A hydrocracking effluent exits the hydrocracking reactor 36 in the hydrocracking effluent line 38. The hydrocracking effluent in line 38 is heat exchanged with the hydrocracking feed in line 34 and in an embodiment may be cooled before entering a cold separator 40. The hydrocracking effluent in line 38 may be mixed with vaporous hydrotreating effluent in line 98 before cooling and entry into the cold separator 40. The cold separator 40 is in downstream communication with the hydrocracking reactor 36 and the pretreat hydrotreating reactor 31. The cold separator may be operated at about 46° C. (115° F.) to about 63° C. (145° F.) and just below the pressure of the hydrocracking reactor 36 accounting for pressure drop to keep hydrogen and light gases such as hydrogen sulfide and ammonia in the overhead and normally liquid hydrocarbons in the bottoms. The cold separator 40 provides the vaporous hydrocracking effluent stream comprising hydrogen in a cold separator overhead line 42 and a liquid hydrocracking effluent stream in a cold separator bottoms line 44. The cold separator also has a boot for collecting an aqueous phase in line 46. The vaporous hydrocracking effluent stream may include vaporous hydrotreating effluent from a warm separator overhead line 98 as will be described hereinafter mixed together in the overhead line 42. The overhead stream in overhead line 42 may be scrubbed with an absorbent solution which may comprise an amine in a scrubber 41 to remove ammonia and hydrogen sulfide as is conventional prior to recycle of the vaporous hydrocracking effluent stream and perhaps the vaporous hydrotreating effluent stream mixed therewith comprising hydrogen to the recycle gas compressor 50.

At least a portion of the hydrocracking effluent stream 38 may be fractionated in a fractionation section 16 in downstream communication with the hydrocracking reactor 36 and the pretreat hydrotreating reactor 31 to produce a diesel stream in line 86. In an aspect, the liquid hydrocracking effluent stream 44 may be fractionated in the fractionation section 16. In a further aspect, the fractionation section 16 may include a cold flash drum 48. The liquid hydrocracking effluent stream 44 may be flashed in the cold flash drum 48 which may be operated at the same temperature as the cold separator 40 but at a lower pressure of between about 1.4 MPa (200 psig) and about 3.1 MPa (gauge) (450 psig) to provide a light liquid stream in a bottoms line 62 from the liquid hydrocracking effluent stream and a light ends stream in an overhead line 64. The aqueous stream in line 46 from the boot of the cold separator may also be directed to the cold flash drum 48. A flash aqueous stream is removed from a boot in the cold flash drum 48 in line 66. The light liquid stream in bottoms line 62 may be further fractionated in the fractionation section 16.

The fractionation section 16 may include a stripping column 70 and a fractionation column 80. The light liquid stream in bottoms line 62 may be heated and fed to the stripping column 70. The light liquid stream which is liquid hydrocracking effluent may be stripped with steam from line 72 to provide a light ends stream of hydrogen, hydrogen sulfide, steam and other gases in an overhead line 74. A portion of the light ends stream may be condensed and refluxed to the stripper column 70. The stripping column 70 may be operated with a bottoms temperature between about 232° C. (450° F.) and about 288° C. (550° F.) and an overhead pressure of about 690 kPa (gauge) (100 psig) to about 1034 kPa (gauge) (150 psig). A hydrocracked bottoms stream in line 76 may be heated in a fired heater and fed to the fractionation column 80.

The fractionation column 80 may also strip the hydrocracked bottoms with steam from line 82 to provide an overhead naphtha stream in line 84, a diesel stream in line 86 from a side cut outlet and an unconverted oil stream in line 88 which may be suitable for further processing, such as in an FCC unit. The overhead naphtha stream in line 84 may require further processing before blending in the gasoline pool. It will usually require catalytic reforming to improve the octane number. The reforming catalyst will often require the overhead naphtha to be further desulfurized in a naphtha hydrotreater prior to reforming. In an aspect, the hydrocracked naphtha may be desulfurized in an integrated hydrotreater 92. It is also contemplated that a further side cut be taken to provide a separate light diesel or kerosene stream taken above a heavy diesel stream taken in line 86. A portion of the overhead naphtha stream in line 84 may be condensed and refluxed to the fractionation column 80. The fractionation column 80 may be operated with a bottoms temperature between about 288° C. (550° F.), and about 385° C. (725° F.), preferably between about 315° C. (600° F.) and about 357° C. (675° F.) and at or near atmospheric pressure. A portion of the hydrocracked bottoms may be reboiled and returned to the fractionation column 80 instead of using steam stripping.

Much of the ammonia and hydrogen sulfide is removed from the hydrocracking effluent before it is fractionated into the diesel stream 86. The diesel stream in line 86 may have a sulfur concentration of no more than 200 wppm and/or a nitrogen concentration of no more than 100 wppm. The diesel stream in line 86 is reduced in sulfur content but may not meet a low sulfur diesel (LSD) specification which is less than 50 wppm sulfur, an ULSD specification which is less than 10 wppm sulfur, or other specifications. The diesel stream in line 86 may have a sulfur concentration of no less than 20 wppm and/or a nitrogen concentration of no less than 10 wppm. Hence, it must be further finished in the hydrotreating unit 14. The diesel stream 86 will include much of the co-feed stream 29 that was co-processed with the primary feed stream in the hydrocracking unit 12. The diesel stream in line 86 may have an initial boiling point between about 121° C. (250° F.) and about 288° C. (550° F.) and an end point of no more than about 399° C. (750° F.).

The diesel stream in line 86 may be joined by the second hydrotreating hydrogen stream taken from the compressed hydrogen stream in the compressed hydrogen line 52 at the split 54 in the second hydrogen split line 56 to provide a hydrotreating feed stream 90. The diesel stream in line 86 may also be mixed with a co-feed that is not shown. The hydrotreating feed stream 90 may be heat exchanged with the hydrotreating effluent in line 94, further heated in a fired heater and directed to the distillate hydrotreating reactor 92 which may be considered a polishing reactor. Consequently, the hydrotreating reactor is in downstream communication with the fractionation section 16, the compressed hydrogen line 52, the pretreat hydrotreating reactor 31 and the hydrocracking reactor 36. In the hydrotreating reactor 92, the diesel stream is hydrotreated in the presence of a hydrotreating hydrogen stream and hydrotreating catalyst to provide a hydrotreating effluent stream 94. In an aspect, all of the hydrotreating hydrogen stream is provided from the compressed hydrogen stream in line 52 via second hydrogen split line 56.

The distillate hydrotreating reactor 92 may comprise more than one vessel and multiple beds of catalyst comprising a hydrotreating catalyst. The hydrotreating reactor 92 in FIG. 1 may have two beds in one reactor vessel. In the hydrotreating reactor, hydrocarbons with heteroatoms are further saturated, demetallized, desulfurized and/or denitrogenated. The hydrotreating reactor may also contain a catalyst that is suited for saturating aromatics, hydrodewaxing and/or hydroisomerization. Hydrogen streams may be injected between or after catalyst beds in the hydrotreating reactor 92 to provide hydrogen requirements and/or to cool hydrotreated effluent.

If the hydrocracking reactor 36 is operated as a mild hydrocracking reactor, the hydrocracking reactor may operate to convert up to about 20-60 vol % of feed boiling above diesel boiling range to product boiling in the diesel boiling range. Consequently, the distillate hydrotreating reactor 92 should have very low conversion and is primarily for desulfurization if integrated with a mild hydrocracking reactor 36 to meet fuel specifications such as to qualify for ULSD.

Hydrotreating is a process wherein hydrogen gas is contacted with hydrocarbon in the presence of suitable catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics. Pour point and cloud point of the hydrotreated product may also be reduced. Suitable hydrotreating catalysts for use in any of the hydrotreating catalyst beds of reactors 31, 36 and 92 of the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts. It is within the scope of the present invention that more than one type of hydrotreating catalyst be used in the same pretreat hydrotreating reactor 31, hydrocracking reactor 36 or distillate hydrotreating reactor 92 and the catalysts used in each reactor may be different. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Noble metal catalysts in Group VIII of the Periodic Table may be useful catalysts in the hydrotreating reactor 92, such as for isomerizing to reduce pour or cloud point and saturating aromatics. Suitable metals are those of the group including platinum, palladium, rhodium, ruthenium, osmium and iridium. A particularly preferred catalytic composite contains a platinum component. The Group VIII metal component may exist within the final composite as a compound such as an oxide, sulfide, halide, etc., or in an elemental state. Generally the amount of the noble metal component is small compared to the quantities of the other components combined therewith. Calculated on an elemental basis, the noble metal component generally comprises from about 0.1 % to about 2.0 wt % of the final composite.

If aromatic saturation is desired, the Group VIII noble metal may be supported on a support material which includes, for example, alumina, silica, silica-alumina and zirconia. A preferred aromatic saturation catalyst contains platinum on amorphous silica-alumina.

If isomerization is desired, any suitable isomerization catalyst may find application. The isomerization catalyst may comprise a Group VIII noble metal on a support. Suitable isomerization catalysts include acidic catalysts using chloride for maintaining the desired acidity.

The isomerization catalyst may be amorphous, e.g., based upon amorphous alumina, or zeolitic. A zeolitic catalyst would still normally contain an amorphous binder.

Because the distillate hydrotreating reactor 92 is operated at high pressure equivalent to the hydrocracking reactor 36, the distillate co-feed from the hydrocracking unit in line 86 can be hydrotreated in the distillate hydrotreating reactor 92 to produce low sulfur diesel or ULSD. Additionally or alternatively, noble metal saturation catalyst can be loaded in the distillate hydrotreating reactor 92 saturate aromatics to produce higher cetane diesel. Furthermore, alternatively or additionally, noble metal isomerization catalyst can be loaded in the distillate hydrotreating reactor 92 to isomerize straight chain paraffins into branched paraffins to produce reduced cloud point diesel. It is contemplated that all, some or any of desulfurization catalyst, aromatic saturation catalyst and isomerization catalyst be loaded into the hydrotreating reactor 92.

Preferred hydrotreating reaction conditions in pretreat hydrotreating reactor 31, hydrotreating reactor 92 and perhaps in hydrotreating catalyst bed 37 in hydrocracking reactor 36 include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 4.1 MPa (600 psig), preferably 6.2 MPa (900 psig) to about 13.1 MPa (1900 psig), a liquid hourly space velocity of the fresh hydrocarbonaceous feedstock from about 0.5 $hr^{-1}$ to about 4 $hr^{-1}$, preferably from about 1.5 to about 3.5 $hr^{-1}$, and a hydrogen rate of about 168 $Nm^3/m^3$ oil (1,000 scf/bbl) to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl). The hydrotreating effluent stream in line 94 may be heat exchanged with the hydrotreating feed stream in line 90. The hydrotreating effluent stream in line 94 may be separated in a warm separator 96 to provide a vaporous hydrotreating effluent stream comprising hydrogen in a warm separator overhead line 98 and a liquid hydrotreating effluent stream in a warm separator bottoms line 100. The vaporous hydrotreating effluent stream comprising hydrogen may be mixed with the hydrocracking effluent stream in line 38 perhaps prior to cooling and enter into the cold separator 40. The warm separator 96 may be operated between about 149° C. (300° F.) and about 260° C. (500° F.). The pressure of the warm separator 96 is just below the pressure of the hydrotreating reactor 92 accounting for pressure drop. The warm separator may be operated to obtain at least 90 wt % diesel and preferably at least 93 wt % diesel in the liquid stream in line 100. All of the other hydrocarbons and gases go up in the vaporous hydrotreating effluent stream in line 98 which joins the hydrocracking effluent in line 38 and may be processed after heating therewith first by entering the cold separator 40. Consequently, the cold separator 40 and, thereby, the recycle gas compressor 50 are in downstream communication with the warm separator overhead line 98. Accordingly, recycle gas loops from both the hydrocracking unit 12 and the hydrotreating unit 14 share the same recycle gas compressor 50. Moreover, at least a portion of the hydrotreating effluent stream in hydrotreating effluent line 94 provided in the warm separator overhead stream comprising hydrogen and hydrocarbons lighter than diesel in the warm separator overhead line 98 is mixed with at least a portion of the hydrocracking effluent stream in hydrocracking effluent line 38 and is processed in the cold separator 40.

The liquid hydrotreating effluent stream in line 100 may be fractionated in a hydrotreating stripper column 102. In an aspect, fractionation of the liquid hydrotreating effluent stream in line 100 may include flashing it in a warm flash drum 104 which may be operated at the same temperature as the warm separator 96 but at a lower pressure of between about 1.4 MPa (200 psig) and about 3.1 MPa (gauge) (450 psig). A warm flash overhead stream in the warm flash overhead line 106 may be joined to the liquid hydrocracking effluent stream in the cold separator bottoms line 44 for further fractionation therewith. Consequently, at least a portion of the hydrotreating effluent stream in line 94 comprising hydrogen provided in the warm flash overhead stream in the warm flash overhead line 106 is mixed with at least a portion of the hydrocracking effluent stream in line 38 provided in the liquid hydrocracking effluent stream in the cold separator bottoms line 44.

The warm flash bottoms stream in line 108 may be heated and fed to the stripper column 102. The warm flash bottoms may be stripped in the stripper column 102 with steam from line 110 to provide a naphtha and light ends stream in overhead line 112. The naphtha and light ends stream in line 112 may be fed to the fractionation section 16 and specifically to the stripping column 70 at a feed point with an elevation above the feed point of light liquid stream in line 62. A product diesel stream is recovered in bottoms line 114 comprising less than 50 wppm sulfur qualifying it as LSD and preferably less than 10 wppm sulfur qualifying it as ULSD. It is contemplated that the stripper column 102 may be operated as a fractionation column with a reboiler instead of with stripping steam.

By operating the warm separator 96 at elevated temperature to reject most hydrocarbons lighter than diesel, the hydrotreating stripping column 102 may be operated more simply because it is not relied upon to separate naphtha from lighter components and because there is very little naphtha to separate from the diesel. Moreover, the warm separator 96 makes sharing of a cold separator 40 with the hydrocracking reactor 36 of the hydrocracking unit 12 possible, and heat useful for fractionation in the stripper column 102 is retained in the hydrotreating liquid effluent.

Figure 2:
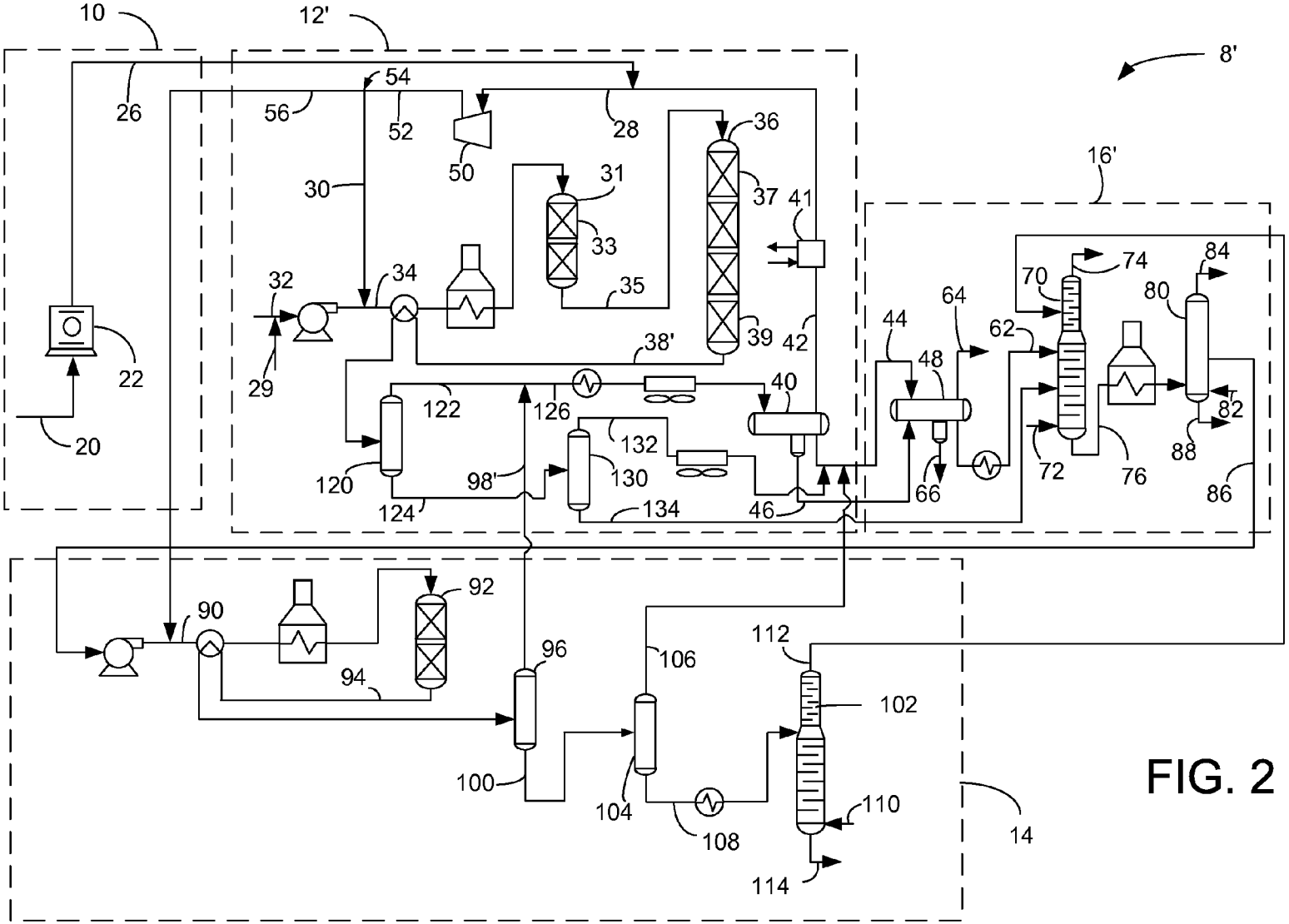
FIG. 2 is a simplified process flow diagram of an alternative embodiment of the present invention.

FIG. 2 illustrates an embodiment of a process 8' that utilizes a hot separator 120 to initially separate the hydrocracking effluent in line 38'. Many of the elements in FIG. 2 have the same configuration as in FIG. 1 and bear the same reference number. Elements in FIG. 2 that correspond to elements in FIG. 1 but have a different configuration bear the same reference numeral as in FIG. 1 but are marked with a prime symbol (').

The hot separator 120 in a hydrocracking unit 12' is in downstream communication with pretreat hydrotreating reactor 31 and the hydrocracking reactor 36 and provides a vaporous hydrocarbonaceous stream in an overhead line 122 and a liquid hydrocarbonaceous stream in a bottoms line 124. The hot separator 120 operates at about 177° C. (350° F.) to about 343° C. (650° F.) and preferably operates at about 232° C. (450° F.) to about 288° C. (550° F.). The hot separator may be operated at a slightly lower pressure than the hydrocracking reactor 36 accounting for pressure drop. The vaporous hydrocarbonaceous stream in line 122 may be joined by the vaporous hydrotreating effluent stream in line 98' from a hydrotreating unit 14' and be mixed and transported together in line 126. The mixed stream in line 126 may be cooled before entering the cold separator 40. Consequently, the vaporous hydrocracking effluent may be separated along with the vaporous hydrotreating effluent stream in the cold separator 40 to provide the vaporous hydrocracking effluent comprising hydrogen in line 42 and the liquid hydrocracking effluent in line 44 and which are processed as previously described with respect to FIG. 1. The cold separator 40, therefore, is in downstream communication with the overhead line 122 of the hot separator 120 and an overhead line 98' of the warm separator 96.

The liquid hydrocarbonaceous stream in bottoms line 124 may be fractionated in a fractionation section 16'. In an aspect, the liquid hydrocarbonaceous stream in line 124 may be flashed in a hot flash drum 130 to provide a light ends stream in an overhead line 132 and a heavy liquid stream in a bottoms line 134. The hot flash drum 130 may be operated at the same temperature as the hot separator 120 but at a lower pressure of between about 1.4 MPa (gauge) (200 psig) and about 3.1 MPa (gauge) (450 psig). The heavy liquid stream in bottoms line 134 may be further fractionated in the fractionation section 16'. In an aspect, the heavy liquid stream in line 134 may be introduced into the stripping column 70 at a feed point with a lower elevation than the feed point of the light liquid stream in line 62.

The rest of the embodiment in FIG. 2 may be the same as described for FIG. 1 with the previous noted exceptions.

Preferred embodiments of this invention are described herein, including the best mode known to the inventors for carrying out the invention. It should be understood that the illustrated embodiments are exemplary only, and should not be taken as limiting the scope of the invention.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated. Pressures are given at the vessel outlet and particularly at the vapor outlet in vessels with multiple outlets.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for producing diesel from a hydrocarbon stream comprising:

hydrotreating a primary hydrocarbon stream and a co-feed hydrocarbon stream comprising diesel in the presence of a hydrogen stream and pretreating catalyst to provide a pretreated effluent stream;

hydrocracking the pretreated effluent stream in the presence of hydrocracking catalyst and hydrogen to provide a hydrocracking effluent stream;

separating the hydrocracking effluent in a separator to provide at least a vaporous hydrocracking effluent stream and a liquid hydrocracking effluent stream; fractionating at least the liquid hydrocracking effluent stream in a fractionation column to provide a diesel stream; and hydrotreating the diesel stream in the presence of a hydrotreating hydrogen stream and hydrotreating catalyst to provide a hydrotreating effluent stream.

2. The process of claim 1 further comprising separating the hydrocracking effluent stream into a vaporous hydrocracking effluent stream comprising hydrogen and a liquid hydrocracking effluent stream; compressing the vaporous hydrocracking effluent stream with a compressed make-up hydrogen stream to provide a compressed hydrogen stream and taking the hydrotreating hydrogen stream from the compressed hydrogen stream.

3. The process of claim 2 further comprising fractionating the liquid hydrocracking effluent stream to remove hydrogen sulfide and ammonia and provide the diesel stream.

4. The process of claim 2 further comprising separating the hydrotreating effluent stream into a vaporous hydrotreating effluent stream comprising hydrogen and a liquid hydrotreating effluent stream and mixing the vaporous hydrotreating effluent stream comprising hydrogen with the hydrocracking effluent stream.

5. The process of claim 2 further comprising separating the hydrotreating effluent stream into a vaporous hydrotreating effluent stream comprising hydrogen and a liquid hydrotreating effluent stream and fractionating the liquid hydrotreating effluent stream comprising at least 90wt % diesel to provide an ultra low sulfur diesel stream.

6. The process of claim 1 wherein the hydrotreating catalyst comprises a noble metal catalyst.

7. The process of claim 1 wherein the hydrotreating catalyst comprises a desulfurization catalyst.

8. The process of claim 1 wherein the hydrotreating catalyst comprises an isomerization catalyst.

9. The process of claim 1 wherein the hydrotreating catalyst comprises an aromatic saturation catalyst.

10. The process of claim 1 wherein the primary hydrocarbon feed stream has an initial boiling point no less than about 150° C. (302° F.) and an end point of no more than about 621° C. (1150° F.).

11. The process of claim 1 wherein the co-feed stream has an initial boiling point between about 121° C. (250° F.) and about 288° C. (550° F.).

12. The process of claim 11 wherein the co-feed has an end point of no more than about 399° C. (750° F.).

13. The process of claim 1 wherein the diesel stream has an initial boiling point between about 121° C. (250° F.) and about 288° C. (550° F.).

14. The process of claim 1 wherein the diesel stream has an end point of no more than about 399° C. (750° F.).

15. The process of claim 14 wherein the diesel stream has a sulfur concentration of no more than 150 wppm.

16. A process for producing diesel from a hydrocarbon stream comprising:

feeding a primary hydrocarbon stream to a pretreat hydrotreating reactor;

co-feeding a co-feed hydrocarbon stream having an initial boiling point between about 121° C. (250° F.) and about 288° C. (550° F.) to said pretreat hydrotreating reactor;

hydrotreating said primary hydrocarbon stream and said co-feed hydrocarbon stream in the presence of a hydrogen stream and pretreating catalyst to provide a pretreated effluent stream;

hydrocracking the pretreated effluent stream in the presence of hydrocracking catalyst and the hydrocracking hydrogen stream remaining in the pretreated effluent stream to provide a hydrocracking effluent stream;

separating the hydrocracking effluent in a separator to provide at least a vaporous hydrocracking effluent stream and a liquid hydrocracking effluent stream; fractionating at least the liquid hydrocracking effluent stream in a fractionation column to provide a diesel stream having an initial boiling point between about 121° C. (250° F.) and about 288° C. (550° F.); and hydrotreating the diesel stream in the presence of a hydrotreating hydrogen stream and hydrotreating catalyst to provide a hydrotreating effluent stream.

17. The process of claim 16 wherein the co-feed stream and the diesel stream both have an end point of no more than about 399° C. (750° F.).

18. The process of claim 16 wherein the hydrotreating catalyst comprises a noble metal catalyst.

19. A process for producing diesel from a hydrocarbon stream comprising:

feeding a primary hydrocarbon stream having an initial boiling point of no less than about 150° C. (302° F.) and an end point of no more than about (565° C.) 1050° F. to a pretreat hydrotreating reactor;

co-feeding a co-feed hydrocarbon stream having an initial boiling point between about 121° C. (250° F.) and about 288° C. (550° F.) to said pretreat hydrotreating reactor;

hydrotreating the primary hydrocarbon stream and the co-feed hydrocarbon stream in the presence of the hydrocracking hydrogen stream and pretreating catalyst to provide a pretreated effluent stream;

hydrocracking the pretreated effluent stream in the presence of hydrocracking catalyst the hydrocracking hydrogen stream remaining in the pretreated effluent stream to provide a hydrocracking effluent stream;

separating the hydrocracking effluent in a separator to provide at least a vaporous hydrocracking effluent stream and a liquid hydrocracking effluent stream; fractionating at least the liquid hydrocracking effluent stream in a fractionation column to provide a diesel stream having an initial boiling point between about 121° C. (250° F.) and about 288° C. (550° F.); and hydrotreating the diesel stream in the presence of a hydrotreating hydrogen stream and hydrotreating catalyst to provide a hydrotreating effluent stream.

20. The process of claim 19 wherein the co-feed stream and the diesel stream both have an end point of no more than about 399° C. (750° F.).

* * * * *